US005116214A

United States Patent [19]

Korsch et al.

[11] Patent Number: 5,116,214

[45] Date of Patent: May 26, 1992

[54] ROTARY TABLET PRESS

[75] Inventors: Wolfgang Korsch; Michael Schmett, both of Berlin, Fed. Rep. of Germany

[73] Assignee: Korsch Maschinenfabrik, Berlin, Fed. Rep. of Germany

[21] Appl. No.: 670,748

[22] Filed: Mar. 15, 1991

[30] Foreign Application Priority Data

Mar. 17, 1990 [DE] Fed. Rep. of Germany ... 9003241[U]

[51] Int. Cl.[5] ..... B30B 11/00

[52] U.S. Cl. ..... 425/345; 425/348 R; 425/353; 425/415

[58] Field of Search ..... 425/193, 195, 344, 345, 425/347, 348 R, 351, 352, 353, 354, 355, 406, 409, 415, 451, 451.4

[56] References Cited

U.S. PATENT DOCUMENTS 2,068,619 1/1937 Bailey ..... 425/353

3,118,183 1/1964 Gex et al. ..... 425/353

3,337,915 8/1967 Alexander, Jr. ..... 425/352

FOREIGN PATENT DOCUMENTS

G8816064.5 4/1989 Fed. Rep. of Germany .

*Primary Examiner*—Jay H. Woo

*Assistant Examiner*—C. Scott Bushey

*Attorney, Agent, or Firm*—McGlew & Tuttle

[57] ABSTRACT

A rotary press for pressing tablets or other cylindrically shaped bodies is provided including a rotor with a die table, an upper section and a lower section. The upper section includes an upper rotatable bushing which supports an upper stamp slidably and non-rotatably. The lower section includes a lower rotatable bushing. The lower rotatable bushing supports a lower stamp slidably and non-rotatably. The upper and lower section each include stationary serrated sections which engage serrated sections provided on the rotatable bushings.

6 Claims, 4 Drawing Sheets

ROTARY TABLET PRESS

FIELD OF THE INVENTION

The invention relates to a circulating press for pressing cylindrically shaped bodies, in particular tablets, comprising a rotor with a die table, an upper section and a lower section, the upper section and the lower section guiding the upper and lower stamps engaging into the dies of the die table, rotating serrated sections assigned to the upper and lower stamps, and stationary serrated sections cooperating with said rotating serrated sections.

BACKGROUND OF THE INVENTION

A circulating press of this species is known in the art from DE-GM 88 16 064. Herein, the upper and lower stamps are adapted rotatably about their longitudinal axes, directly after passing the pressure rollers loading the latter. The rotation of the upper and lower stamps about their longitudinal axes is achieved either by a frictional connection of the upper and lower stamps with guide cam sections arranged directly behind the pressure rollers loading the upper and lower stamps and adapted to be pressed under spring action against the upper and lower stamps, or by cooperation of a serrated section provided at the shaft of the stamp with a stationarily disposed toothed rack. By the rotational movement of upper and lower stamps directly after the pressing procedure and during the extraction of the upper and lower stamps from the die of the die table, it is intended to obtain a separation of the surface of the pressed tablet at least from the upper stamp. With particularly adhering materials to be pressed, a rotational movement of the lower stamp is to avoid the adhesion between the latter and the lower side of the tablet.

It is disadvantageous, with the frictional connection between upper and lower stamps and the respective guide cam sections, however, that, hereby, on one hand, there is wear, and, on the other hand, no defined rotation of upper and lower stamps is performed. With different rotations, e.g., of upper and lower stamps, even a destruction of the pressed shaped body must be expected. With the serrated section provided at the shaft of the stamp, it is disadvantageous, on one hand, that particularly adapted upper and lower stamps have to be employed, and, on the other hand, that friction between the serrated sections of upper and lower stamps and the respective stationary toothed racks will occur, since the serrated section of the upper and lower stamps will be moved, together with the latter, in axial direction of the upper and lower stamps. It is disadvantageous, further, that, with the engagement of the serrated sections into the respective, stationarily arranged toothed rack, jamming may occur, depending on in which position the respective upper or lower stamp has remained after leaving the respective toothed rack. In total, with this prior art circulating press, there is the disadvantage that the rotation of the upper and lower stamps is achieved only after passing the pressure rollers loading the latter. This is disadvantageous in that the pressed shaped bodies will adhere already, before a rotational movement takes place.

From U.S. Pat. No. 3,337,915, there is known a circulating press of a different species, wherein the upper and lower stamps are also rotated after passing the respective pressure rollers. The rotation is performed, here, under application of a pressure force, which is, however, smaller than the pressure force exerted by the pressure rollers. For rotating the upper and lower stamps, there are mounted thereon cams, which will run, immediately after passing the pressure rollers, against interior or exterior cam rollers causing a swinging action of the cams and thus of the upper and lower stamps under loading by a smaller pressure force. It is disadvantageous, here, that the cams running against the cam rollers will cause noise, and that the cams assigned to the individual upper and lower stamps will not allow for a variation of the angle of rotation of the upper and lower stamps, unless the individual cams of each upper and lower stamp are replaced by differently shaped cams. In an embodiment of this circulating press of a different species, the upper and lower stamps are axially movably, but non-rotatably guided in sleeves, at which cams are attached. For a variation of the angle of rotation of the upper and lower stamps, however, even the sleeves have to be replaced here, which is extremely time-consuming.

Further, from U.S. Pat. No. 3,118,183, there is known in the art a circulating press, also of a different species, wherein the rotation of upper and lower stamps is achieved simultaneously with the pressing procedure by loading upper and lower stamps by pressure rollers. In an embodiment thereof, friction wheels are employed for rotating the upper and lower stamps. This does not allow for a synchronous movement of upper and lower stamps, and causes, in particular under consideration of the simultaneously occurring, relative high pressure forces caused by the pressure rollers, relatively high wear. In another embodiment, cam-type members are inserted into cross slots of upper and lower stamps, which cooperate with stationarily disposed cam rollers. Here, too, in particular under consideration of the simultaneously occurring pressure forces, high wear will occur, and there will be a rattling noise within the circulating press.

SUMMARY AND OBJECTS OF THE INVENTION

It is an object of the invention, to provide a circulating press of the mentioned species, wherein an accurate engagement of the serrated sections of upper and lower stamps into the stationary serrated section is possible, and wherein no friction between the serrated sections will occur when moving the upper and lower stamps in an axial direction.

As a solution for this object, the novelty provides that the upper and lower stamps are supported slidably and non-rotatably within rotatable bushings, rotatable bushings are inserted into the upper section or into the lower section, and are provided with the serrated sections. Herein, standard upper and lower stamps can be used, which are supported slidably in the bushings, but non-rotatably, e.g. by a groove-and-tongue joint. The bushings themselves are inserted rotatably into the upper and lower sections of the rotor, and are provided with the serrated sections, which cooperate with stationary serrated sections. In this way, an accurate engagement of the rotating serrated sections of the bushings guiding the stamps with the stationary serrated sections is achieved, and any wear during an axial movement of the upper and lower stamps is avoided.

The stationary serrated sections for the upper stamps are arranged on the interior side, and the stationary serrated sections of the lower stamps are arranged on the exterior side of the upper and lower sections of the rotor carrying the rotatable bushings. Hereby, a uniform running of upper and lower stamps in a desired direction of rotation is obtained. In the preferred embodiment, the stationary serrated sections are formed, for rotors or die tables having large diameters, of toothed segments, which are arranged with their partial circles for the serrated sections of the upper stamps on the interior side of the rotor, or for the serrated sections of the lower stamps on the exterior side of the rotor. The rotatable serrated sections of the bushings guiding the upper and lower stamps are provided with indexable latching devices. These latching devices effect that the bushings including the serrated sections are precisely fixed after leaving the toothed segments, so that the engagement of the rotating serrated sections of the bushings into the respective is achieved accurately, so that no jammings between the serrated sections on either side will occur. The stationary serrated sections are formed, for die tables having a small diameter, of toothed wheels with internal or external toothing. In this embodiment, there is a continuous rotational movement of the stamps, which are rotated even during the pressing procedure under the pressure rollers. In the other embodiment, the serrated segments are located in the area of the pressure rollers, so that the rotational movement of the upper and lower stamps takes place only before, during and immediately after the pressing procedure.

BRIEF DESCRIPTION OF THE DRAWINGS

In the following, the novelty is described in more detail, based on two embodiments shown in the drawings of circulating presses for pressing cylindrically shaped bodies, in particular tablets. There are.

DETAILED DESCRIPTION OF THE PREFERRED EMBODIMENTS

Figure 1:
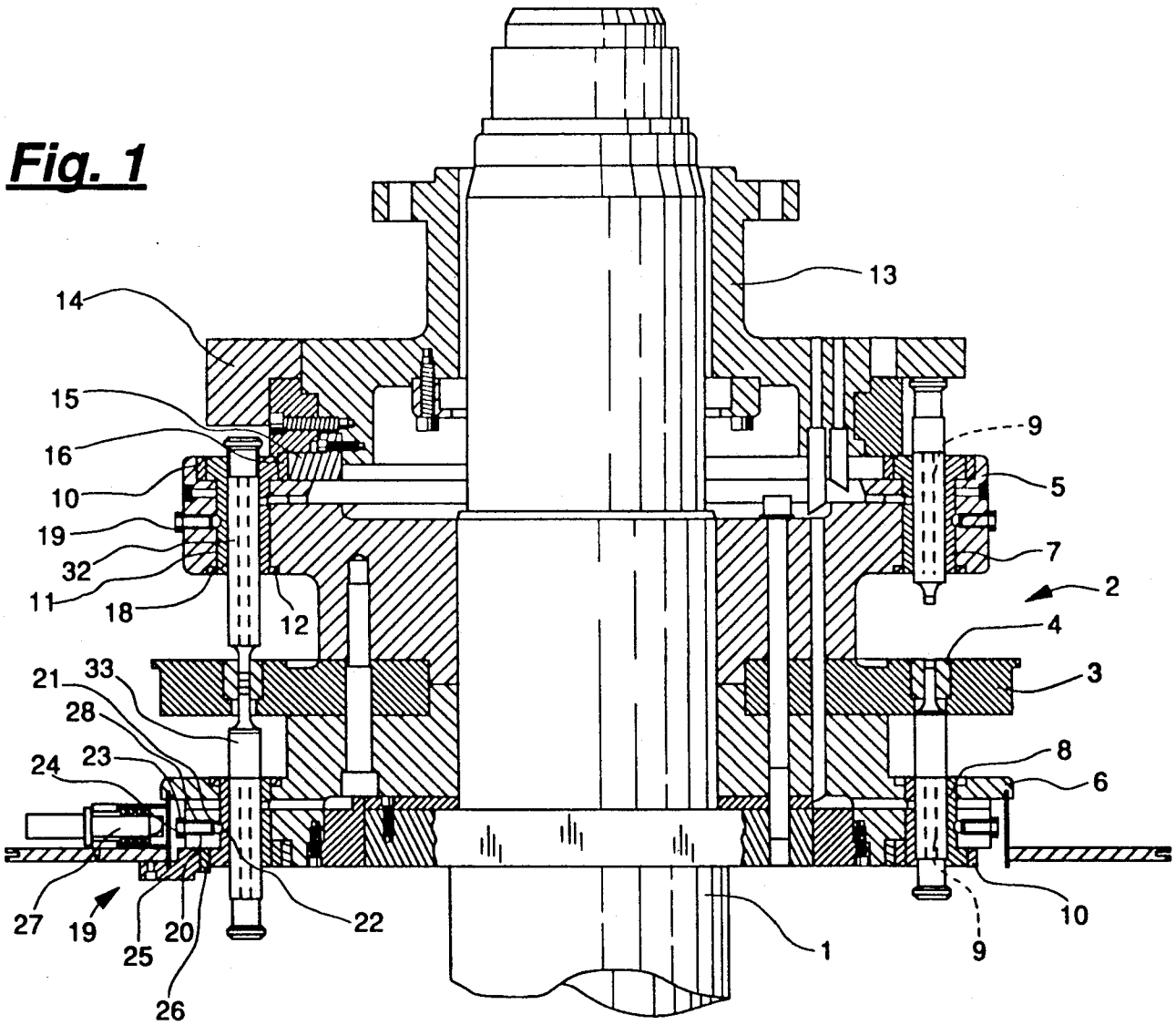
FIG. 1 a vertical section through a circulating press in the first embodiment.
Figure 2:
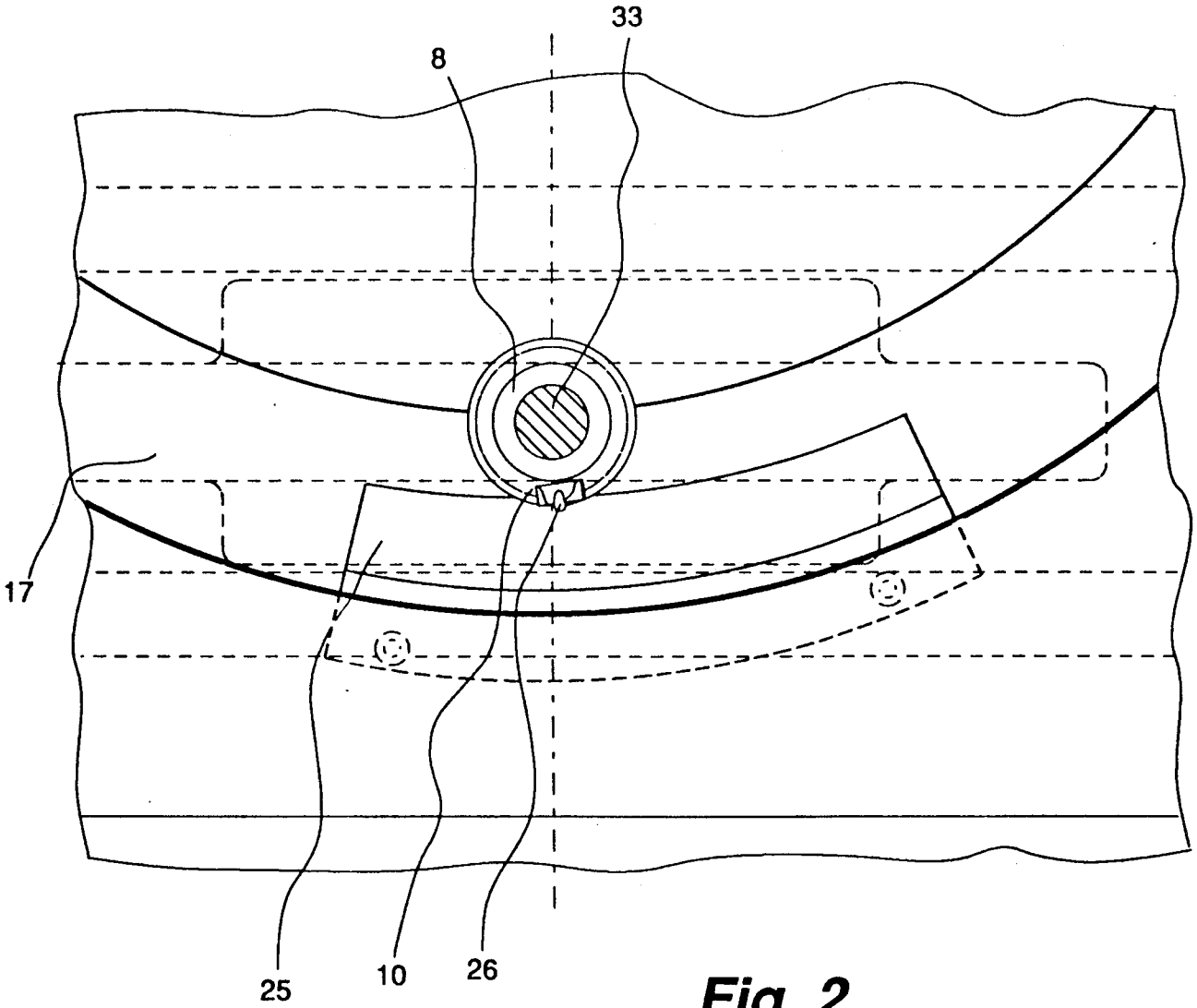
FIG. 2 a detail cross section.

The circulating press for pressing cylindrically shaped bodies, in particular tablets, comprises, in the first embodiment according to FIGS. 1 and 2, a rotating, vertical axle 1 for a rotor 2 disposed non-rotatably thereon, said rotor being formed of a disk-type die table 3 with the dies 4 disposed on a radius, and of an upper section 5 and a lower section 6 carrying rotatable bushings 7, 8 assigned to the dies 4, wherein the upwardly and downwardly movable upper or lower stamps 32, 33, resp., are guided. These are moved upwardly and downwardly by curved (cams, and press, under the action of pressure rollers 17 (See FIG. 2), the powder material filled into the dies 4 to shaped bodies, in particular to tablets. Filling shoes for the powder material and strippers for the finished shaped bodies are provided.

The bushings 7 rotatably supported in the upper section 5 of the rotor 2 include a longitudinal groove 9 for engagement with a non-shown matching spring, which is provided in the upper stamp 32. In this way, a commercially available upper stamp 32 can be used, which is slidable within the interior bore 18 of the bushing 7, with corresponding play, which is however, non-rotatably held in the bushing 7 by the engagement of the matching spring into the groove 9. The bushing 7 comprises, at the outside of its upper section, an external serrated section 10, which is formed as one piece with the bushing 7. The bushing 7 is mounted freely rotatably in an axial borehole 11 of the upper section 5, said borehole being adapted corresponding to the outer diameter thereof. In the lower section of the borehole 11, there is inserted a sealing ring 12, closing the gap between the bushing 7 and the borehole 11.

Above the rotor 1, a bell cam 13 is provided, which is attached non-rotatably at the frame of the circulating press not shown in more detail. The bell cam 13 supports, on one hand, on its outside the upper stamp cam 14, and on the other hand, below the latter, a internal toothed gear 15 with an external serrated section 16, coming into engagement with the external serrated section 10 of the bushing 7, as is shown in FIG. 2. The internal toothed wheel segment 15 is, then, in the area of the pressure roller 17 for the upper stamp 32, as is also shown in FIG. 2, so that the upper stamp 32 is rotated over the bushing 7 guiding it in the area before, below and behind the pressure roller 17. The rotation of the upper stamp 32 is determined by the number of teeth of the external serrated section 10 of the bushing 7, and by the number of teeth of the external serrated section 16 of the internal toothed wheel segment 15. By the respective number of teeth, a rotation of the upper stamp 18 by 36°, 72° or 360° or by other angles can be performed.

For securing the accurate engagement of the external serrated section 10 of the bushing 7 into the external serrated section 16 of the internal toothed wheel segment 15 being stationarily mounted at the bell cam 13, an indexable latching device 19 is provided in the upper section 5 of the rotor 2, said indexable latching device being composed of a radial bore 20 in the upper section 5, a ball 21 guided therein, a spherical segment 22 provided on the outside of the bushing 7, a spring 23 arranged in the radial bore 20, and a pressure piece 24 closing the radial bore 20 towards outside. Instead of a single spherical segment 22 for a rotation of the bushing 7 by 360°, several spherical segments 22 can also be provided for partial rotations by, e.g., 36° or 72°. In each case, the ball 21 will latch in a spherical segment 22, as soon as the serrated sections 10, 16 have come out of engagement, so that a new engagement of the serrated sections 10 and 16 can take place without any jamming.

The bushings 8 in the lower section 6 of the rotor 2 are adapted in a similar way as the bushings 7 in the upper section 5, the external serrated sections 10 being provided on the lower side of the bushings 8. Further, an external toothed segment 25 having an internal serrated section 26 is rigidly attached at the non-shown frame of the circulating press, the serrated section 10 of the bushing 8 of the lower section 6 of the rotor 2 engaging into the internal serrated section 26 of the external toothed segment 25. In the same way as for the bushings 7 of the upper section 5, a latching device 19 is provided for the bushings 8 of the lower section 6. To both latching devices 19 in the upper section 5 and in the lower section 6 are assigned proximity switches 27 detecting the accurate locking of the balls 21 in the spherical segments 22. If a bushing 7, 8 should come to standstill, without the ball 21 being latched in a spherical segment 22, the circulating press will be switched off, caused by a signal of a proximity switch 27. The proximity switches 27 of the latching devices 19 detect the position of a latching pin 28 within the radial bore 20, the position of the latching pin 28 depending on the latching action of the ball 21 in the spherical segment 22.

Figure 3:
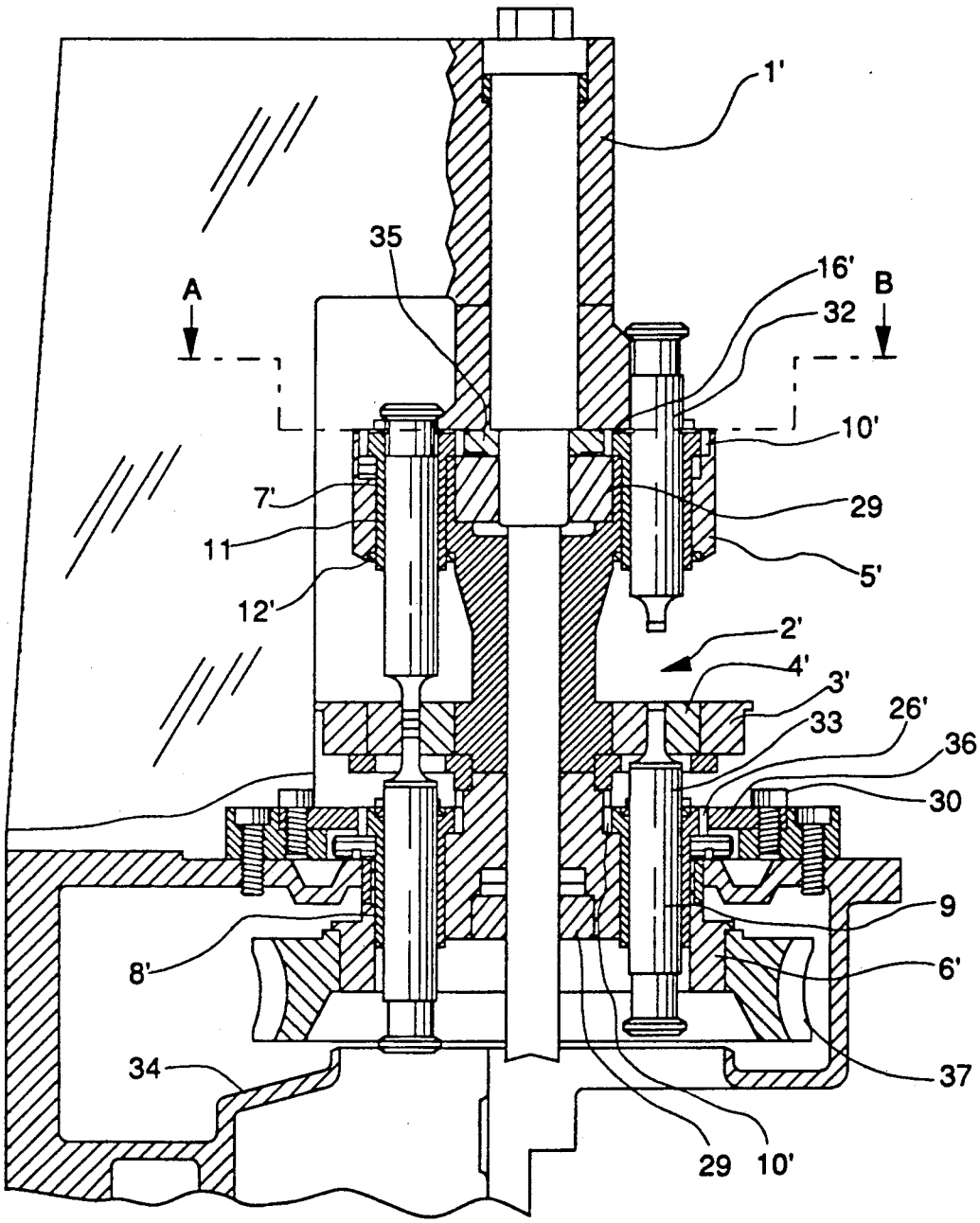
FIG. 3 a vertical section through a circulating press in the second embodiment, and FIG. 4 a cross section through the circulating press according to FIG. 3 along line IV—IV thereof.
Figure 4:
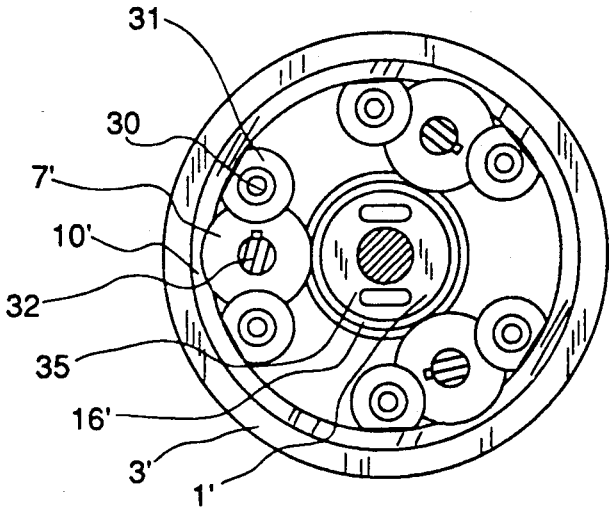

In the second embodiment of the circulating press shown in FIGS. 3 and 4, the rotor 2' is rotatably supported on an axle 1' over ball bearings 29. In the same way as in the first embodiment, dies 4' are provided in the die table 3'. In the upper section 5', there are rotatable bushings 7'. In the lower section 6' are provided the rotatable bushings 8'. The bushings 7', 8' are, in same way as in the first embodiment, inserted with grooves 9' for a non-rotatable axial guiding of the upper and lower stamps 32, 33. The bushings 7', 8' secured by threaded bolts 30 screwed laterally to the outer diameters of the respective bushing bores 11' into the upper section 5' or into the lower section 6', resp., and by disks 31 slid thereon. Further, sealing rings 11' for the bushings 7' are provided in the upper section 5'.

In contrast to the first embodiment of the circulating press shown in FIGS. 1 and 2, the second embodiment of the circulating press shown in FIGS. 3 and 4 has a smaller diameter of the disk-shaped die table 3' and thus also of the disk-shaped upper and lower sections 5' or 6', resp. Thus, in this embodiment, the upper and lower stamps 32, 33 can always rotate. For this purpose, there is provided, stationary about the fixed axle 1', a toothed wheel 35 with an external serrated section 16', into which the external serrated sections 10' of the bushings 7' of the upper section 5' permanently engage. In corresponding manner, a toothed wheel 36 provided with an internal serrated section 26' is provided, with which the external serrated sections 10' of the bushings 8' of the lower section 6' are permanently in engagement. In this way, the bushings 7', 8' of upper sections 5' and of lower section 6' of the rotor 2' will permanently rotate, so that the upper and lower stamps inserted into the bushings 7', 8' are always subjected to rotation. The rotational movement of the rotor 2' takes place by a worm wheel 37 being in engagement with a non-shown worm, said worm wheel being disposed in the housing 34 of the circulating press.

We claim:

1. A rotary press for pressing cylindrically shaped bodies, the rotary press comprising:

a rotor with a die table, an upper section and a lower section;

an upper rotatable bushing supported by said upper section;

a lower rotatable bushing supported by said lower section;

an upper stamp supported slidably and non-rotatably within said upper rotatable bushing;

a lower stamp supported slidably and non-rotatably within said lower rotatable bushing, each of said upper stamp and said lower stamp engaging into at least one die of said die table;

an upper stationary serrated section;

a lower stationary serrated section;

an upper rotatable bushing serrated section connected to said upper bushing and cooperating with said upper stationary serrated section; and, a lower rotatable bushing serrated section, connected to said lower rotatable bushing, cooperating with said lower stationary serrated section.

2. A rotary press according to claim 1, wherein said upper stationary serrated section is arranged on an interior side of said rotor with respect to said upper rotatable bushing and said lower stationary serrated section is arranged on an exterior side of said rotor, with respect to said lower rotatable bushing.

3. A rotary press according to claim 1 ,wherein said upper rotatable bushing with upper rotatable bushing serrated section is provided with an indexable latching device and said lower rotatable bushing with lower rotatable serrated section is provided with an indexable latching device.

4. A rotary press according to claim 1, wherein each of said upper stationary serrated section and lower stationary serrated section includes toothed segments which are arranged forming partial circles for said die table, said upper stationary serrated section having said toothed segments directed outwardly and said lower stationary serrated section having toothed segments directed inwardly.

5. A rotary press according to claim 2, wherein said upper stationary serrated section is formed of a toothed wheel positioned inwardly of said rotatable bushing and said lower stationary serrated section is formed of a toothed wheel positioned outwardly of said rotatable bushing.

6. A rotary press according to claim 1, wherein pressure rollers are provided for pressing the shaped bodies, said upper and lower stationary serrated sections each being located adjacent said pressure rollers.

* * * * *